US010611611B2

(12) United States Patent
Mellott et al.

(10) Patent No.: US 10,611,611 B2
(45) **Date of Patent: *Apr. 7, 2020**

(54) DUAL ACTUATOR ASSEMBLY

(71) Applicant: Oshkosh Corporation, Oshkosh, WI (US)

(72) Inventors: Lex A. Mellott, Warforsburg, PA (US); Eric T. Welsh, Winchester, VA (US)

(73) Assignee: Oshkosh Corporation, Oshkosh, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/411,983

(22) Filed: May 14, 2019

(65) Prior Publication Data

US 2019/0263639 A1 Aug. 29, 2019

Related U.S. Application Data

(63) Continuation of application No. 15/479,812, filed on Apr. 5, 2017, now Pat. No. 10,294,086.
(Continued)

(51) Int. Cl.
*B66C 23/00* (2006.01)
*B66F 11/04* (2006.01)
(Continued)

(52) U.S. Cl.
CPC ..... *B66C 23/54* (2013.01); *B66F 11/044* (2013.01); *E02F 9/2271* (2013.01); *E02F 3/425* (2013.01)

(58) Field of Classification Search
CPC ..... B66C 23/54; B66C 23/86; B66C 23/80; B66C 13/00; G02B 7/001; A47C 3/20;
(Continued)

(56) References Cited

U.S. PATENT DOCUMENTS 3,155,351 A 11/1964 Lear
3,861,534 A 1/1975 Birdwell
(Continued)

FOREIGN PATENT DOCUMENTS

CN 202718153 U 2/2013
CN 204224143 U 3/2015
(Continued)

OTHER PUBLICATIONS

International Search Report and Written Opinion re: International Application No. PCT/US2014/026170, dated Jul. 5, 2017, 17 pps.

*Primary Examiner* — Christopher Garft
(74) *Attorney, Agent, or Firm* — Foley & Lardner LLP

(57) ABSTRACT

A boom assembly includes a first boom, a second boom pivotally coupled to the first boom, and an actuator assembly having (i) a first end coupled to at least one of the first boom or the second boom and (ii) an opposing second end coupled to the second boom. The actuator assembly includes a first actuator, a second actuator flexibly joined to the first actuator at the opposing second end of the actuator assembly, and a rigid coupler positioned to fixedly couple the first actuator and the second actuator together at the first end of the actuator assembly. The rigid coupler is configured to pivotally couple the first end of the actuator assembly to the at least one of the first boom or the second boom. The first actuator and the second actuator are configured to move relative to one another in response to various loading conditions.

18 Claims, 4 Drawing Sheets

Related U.S. Application Data

(60) Provisional application No. 62/319,227, filed on Apr. 6, 2016.

(51) Int. Cl.
*E02F 9/22* (2006.01)
*E02F 3/42* (2006.01)

(58) Field of Classification Search
CPC .. F16M 11/04; F16M 11/24; F16M 2200/044; A61B 90/50; F16F 9/0209; F16F 9/049; B66F 11/044; E02F 9/2271; E02F 3/425
USPC ..... 267/294, 64.11, 300.3, 301.2, 303.2, 267/302.2, 124, 118, 113; 212/260, 255, 212/341, 261, 304, 297; 248/288.11, 248/123.11, 654, 631, 162.1, 280.11, 248/292.11, 297.11
See application file for complete search history.

(56) References Cited

U.S. PATENT DOCUMENTS

| | | | | |
|---|---|---|---|---|
| 4,464,093 | A | 8/1984 | Baron et al. | |
| 4,993,911 | A * | 2/1991 | Grant | B66C 13/18 212/261 |
| 5,188,247 | A * | 2/1993 | Jastrow | B66C 23/48 212/257 |
| 5,743,149 | A * | 4/1998 | Cullity | B66F 11/046 74/490.05 |
| 6,260,720 | B1 | 7/2001 | Gunnarsson et al. | |
| 6,488,161 | B1 * | 12/2002 | Bean | B66F 11/046 182/2.9 |
| 7,210,525 | B2 | 5/2007 | Dallas | |
| 7,559,396 | B2 * | 7/2009 | Schwindt | B62K 25/283 180/227 |
| 7,677,347 | B2 * | 3/2010 | Brawn | B60G 17/06 180/227 |
| 8,515,627 | B2 | 8/2013 | Marathe et al. | |
| 8,899,901 | B2 * | 12/2014 | Hilton | E21B 19/14 414/22.54 |
| 2005/0161576 | A1 * | 7/2005 | Boehm | A47C 3/30 248/631 |
| 2007/0241074 | A9 | 10/2007 | Davis | |
| 2009/0315376 | A1 * | 12/2009 | Nishiwaki | A61G 5/006 297/301.2 |
| 2012/0292470 | A1 * | 11/2012 | Ackermann | F15B 15/08 248/222.11 |
| 2014/0079519 | A1 | 3/2014 | Hobenshield | |
| 2015/0298944 | A1 | 10/2015 | Leinonen et al. | |
| 2015/0336776 | A1 | 11/2015 | St-Yves | |

FOREIGN PATENT DOCUMENTS

| | | | |
|---|---|---|---|
| CN | 104925712 | A | 9/2015 |
| EP | 2 148 014 | A2 | 1/2010 |
| EP | 2 148 014 | A3 | 1/2010 |
| EP | 2 455 554 | | 5/2012 |
| FR | 1575153 | A | 7/1969 |
| GB | 1 573 681 | A | 8/1980 |
| WO | WO-2011/128510 | A1 | 10/2011 |

* cited by examiner

DUAL ACTUATOR ASSEMBLY

CROSS-REFERENCE TO RELATED PATENT APPLICATIONS

This application is a continuation of U.S. patent application Ser. No. 15/479,812, filed Apr. 5, 2017, which claims the benefit of U.S. Provisional Patent Application No. 62/319,227, filed Apr. 6, 2016, both of which are incorporated herein by reference in their entireties.

BACKGROUND

Traditional articulated boom lifts may include a chassis, a turntable coupled to the chassis, and a boom assembly. An end of a first boom section is coupled to the turntable, and an opposing end of the first boom section may be coupled to a second boom section. A lift cylinder elevates the first boom section relative to the turntable and/or the second boom section relative to the first boom section, thereby elevating an implement (e.g., work platform, forks, etc.) that is coupled to the boom assembly.

SUMMARY

One embodiment relates to a boom assembly. The boom assembly includes a first boom, a second boom pivotally coupled to the first boom, and an actuator assembly having (i) a first end coupled to at least one of the first boom or the second boom and (ii) an opposing second end coupled to the second boom. The actuator assembly includes a first actuator, a second actuator flexibly joined to the first actuator at the opposing second end of the actuator assembly, and a rigid coupler positioned to fixedly couple the first actuator and the second actuator together at the first end of the actuator assembly. The rigid coupler is configured to pivotally couple the first end of the actuator assembly to the at least one of the first boom or the second boom. The first actuator and the second actuator are configured to move relative to one another in response to various loading conditions.

Another embodiment relates to an actuator assembly for a lift device. The actuator assembly includes a first actuator having a first end and an opposing second end, a second actuator having a third end and an opposing fourth end, a first coupler positioned to rigidly couple the first end of the first actuator and the third end of the second actuator together, a second coupler positioned at the opposing second end of the first actuator, and a third coupler positioned at the opposing fourth end of the second actuator. The first coupler is configured to pivotally couple the first end of the first actuator and the third end of the second actuator to a base of the lift device or a boom assembly of the lift device. The second coupler is configured to pivotally couple the opposing second end of the first actuator to the boom assembly, independent of the second actuator. The third coupler is configured to pivotally couple the opposing fourth end of the second actuator to the boom assembly, independent of the first actuator.

Still another embodiment relates to a lift device. The lift device includes a base, a boom pivotally coupled to the base, and an actuator assembly having (i) a first end coupled to one of the boom or the base and (ii) an opposing second end coupled the boom. The actuator assembly includes a first actuator, a second actuator, a rigid coupler coupling the first actuator and the second actuator together proximate one of the first end or the opposing second end of the actuator assembly, and a flexible coupler coupling the first actuator and the second actuator together proximate the other of the first end or the opposing second end of the actuator assembly.

The invention is capable of other embodiments and of being carried out in various ways. Alternative exemplary embodiments relate to other features and combinations of features as may be generally recited in the claims.

BRIEF DESCRIPTION OF THE DRAWINGS

The invention will become more fully understood from the following detailed description taken in conjunction with the accompanying drawings wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

According to an exemplary embodiment, a lift device includes an actuator assembly having two or more actuators (e.g., hydraulic cylinders, etc.) that are coupled (e.g., thereby forming a conjoined twin actuator arrangement, a parallel actuator assembly, etc.). In one embodiment, the two or more actuators are identical. The actuator assembly may be configured to selectively reposition (e.g., lift, rotate, elevate, etc.) at least a portion of a boom assembly including a first boom (e.g., a lower boom, a tower boom, etc.) and a second boom (e.g., a main boom, an upper boom, etc.). According to an exemplary embodiment, first ends (e.g., lower ends, etc.) of the two or more actuators are rigidly joined (e.g., with a single, rigid clevis bracket, etc.). In one embodiment, the first end of the actuator assembly is coupled to the first boom and the second boom with an intermediate link. In other embodiments, the first end of the actuator assembly is coupled to the first boom with an intermediate link. In still other embodiments, the first end of the actuator assembly is directly coupled to the first boom. According to an exemplary embodiment, a second end (e.g., an upper end, etc.) of the actuator assembly is directly coupled to the second boom. Second ends of the two or more actuators are flexibly coupled (e.g., with a flexible joint member, etc.), according to an exemplary embodiment. In one embodiment, the flexibly joined end of each actuator of the actuator assembly includes a coupler (e.g., a clevis bracket, etc.) configured to interface the respective actuator with the second boom. Such an actuator assembly having conjoined twin actuators may facilitate the use of smaller diameter and less expensive actuators (e.g., hydraulic cylinders, etc.) in place of a single, larger diameter and more expensive actuator, thereby reducing the cost of the actuator assembly and lift device. The lift device may have a reduced overall height when configured in a stowed and/or non-extended orientation. By way of example, a lift device having the actuator assembly may have a more compact stowed and/or non-extended height relative to lift devices having a similarly-positioned single, larger diameter actuator design. By way of another example, a lift device having the actuator assembly may meet or exceed stowed height requirements for shipping and/or transport.

Figure 1:
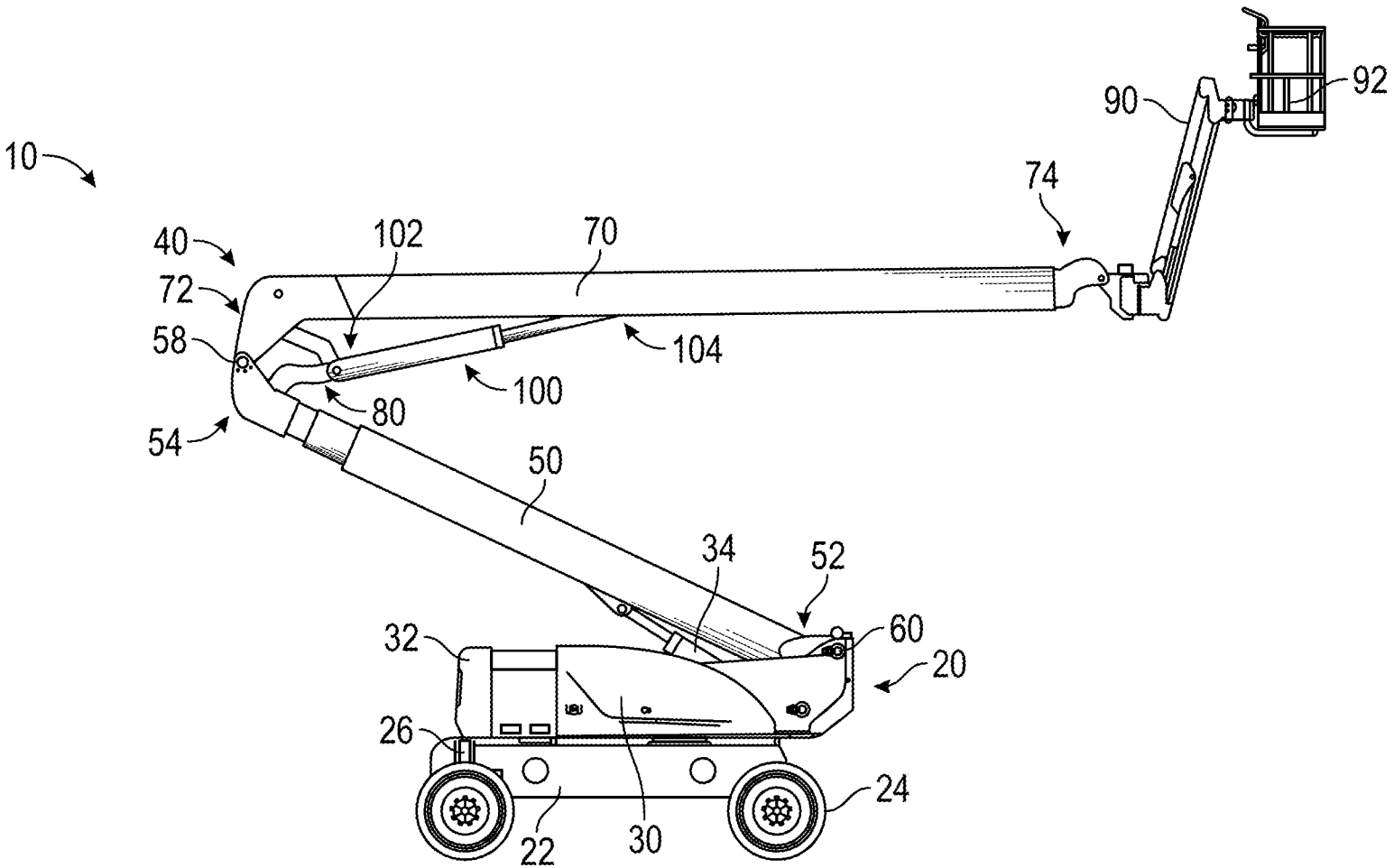
FIG. 1 is a side view of a lift device including a boom assembly, according to an exemplary embodiment.

According to the exemplary embodiment shown in FIGS. 1-4, a lift device (e.g., an aerial work platform, a telehandler, a boom lift, a boom truck, etc.), shown as lift device 10, includes a boom assembly, shown as boom 40, coupled to a base, shown as lift base 20. As shown in FIG. 1, the lift base 20 includes a chassis, shown as chassis 22, and a supporting base structure, shown as turntable 30, that is supported by the chassis 22. According to an exemplary embodiment, the turntable 30 is rotatable relative to the chassis 22. As shown in FIG. 1, the turntable 30 includes a counterweight, shown as tail counterweight 32, coupled to a rear of the turntable 30. In other embodiments, the tail counterweight 32 is otherwise positioned and/or at least a portion of the weight thereof is otherwise distributed throughout the lift device 10 (e.g., on the chassis 22, on a portion of the boom 40, etc.). As shown in FIG. 1, the chassis 22 is supported by a plurality of tractive elements, shown as tractive elements 24. According to the exemplary embodiment shown in FIG. 1, the tractive elements 24 include wheels. In other embodiments, the tractive elements 24 include a track element. According to an exemplary embodiment, the tractive elements 24 are driven by a drive system, shown as drive system 26. The drive system 26 may be controlled from a cab, a control panel at the turntable 30, a control panel at a platform assembly, or from still another location.

Figure 2:
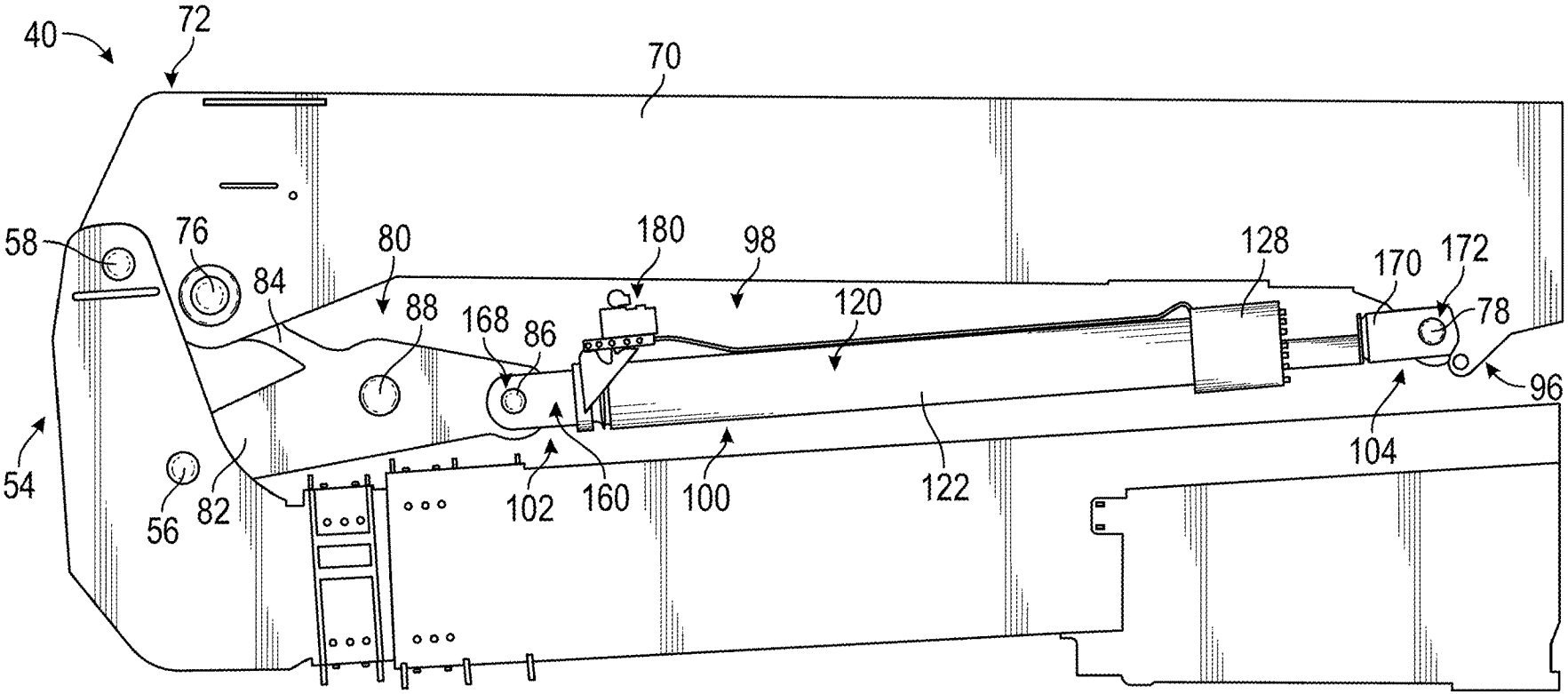
FIG. 2 is a detailed side view of a boom assembly with an actuator assembly, according to an exemplary embodiment.

As shown in FIGS. 1 and 2, the boom 40 includes a first, lower boom, shown as tower boom 50, and a second, upper boom, shown as main boom 70. According to an exemplary embodiment, the boom 40 is an articulating boom assembly. In one embodiment, the main boom 70 has a length that is greater than tower boom 50. According to another exemplary embodiment, the boom 40 is a telescopic, articulating boom assembly. By way of example, the main boom 70 and/or the tower boom 50 may include a plurality of telescoping boom sections that are capable of extending and retracting along a longitudinal centerline to selectively increase and decrease a length thereof.

As shown in FIGS. 1 and 2, the tower boom 50 has a first end (e.g., lower end, etc.), shown as base end 52, and an opposing second end, shown as upper end 54. As shown in FIG. 1, the base end 52 of the tower boom 50 is pivotally coupled (e.g., pinned, etc.) to the turntable 30 at a joint, shown as tower boom pivot 60. As shown in FIG. 1, the boom 40 includes a first actuator (e.g., pneumatic cylinder, electric actuator, hydraulic cylinder, etc.), shown as tower lift cylinder 34. The tower lift cylinder 34 has a first end coupled to the turntable 30 and an opposing second end coupled to the tower boom 50. According to an exemplary embodiment, the tower lift cylinder 34 is positioned to raise and lower the tower boom 50 relative to the turntable 30 about the tower boom pivot 60.

As shown in FIGS. 1 and 2, the main boom 70 has a first end, shown as lower end 72, and an opposing second end, shown as upper end 74. As shown in FIGS. 1 and 2, the lower end 72 of the main boom 70 is pivotally coupled (e.g., pinned, etc.) to the upper end 54 of the tower boom 50 at a joint, shown as main boom pivot 58. As shown in FIG. 1, the boom 40 includes an implement, shown as platform assembly 92, coupled to the upper end 74 of the main boom 70 with an extension arm, shown as jib arm 90. In some embodiments, the jib arm 90 is configured to facilitate pivoting the platform assembly 92 about a lateral axis (e.g., up and down, etc.). In some embodiments, the jib arm 90 is configured to facilitate pivoting the platform assembly 92 about a vertical axis (e.g., left and right, etc.). In some embodiments, the jib arm 90 is configured to facilitate extending and retracting the platform assembly 92 relative to the upper end 74 of the main boom 70. According to an exemplary embodiment, the platform assembly 92 is a structure that is capable of supporting one or more workers. In some embodiments, an accessory or tool is coupled to the platform assembly 92 for use by a worker. Such tools may include pneumatic tools (e.g., impact wrench, airbrush, nail gun, ratchet, etc.), plasma cutters, welders, spotlights, etc. In some embodiments, the platform assembly 92 includes a control panel to control operation of the lift device 10 (e.g., the turntable 30, the boom 40, etc.) from the platform assembly 92. In other embodiments, the platform assembly 92 is replaced with and/or includes an accessory or tool (e.g., forklift forks, etc.).

Figure 3:
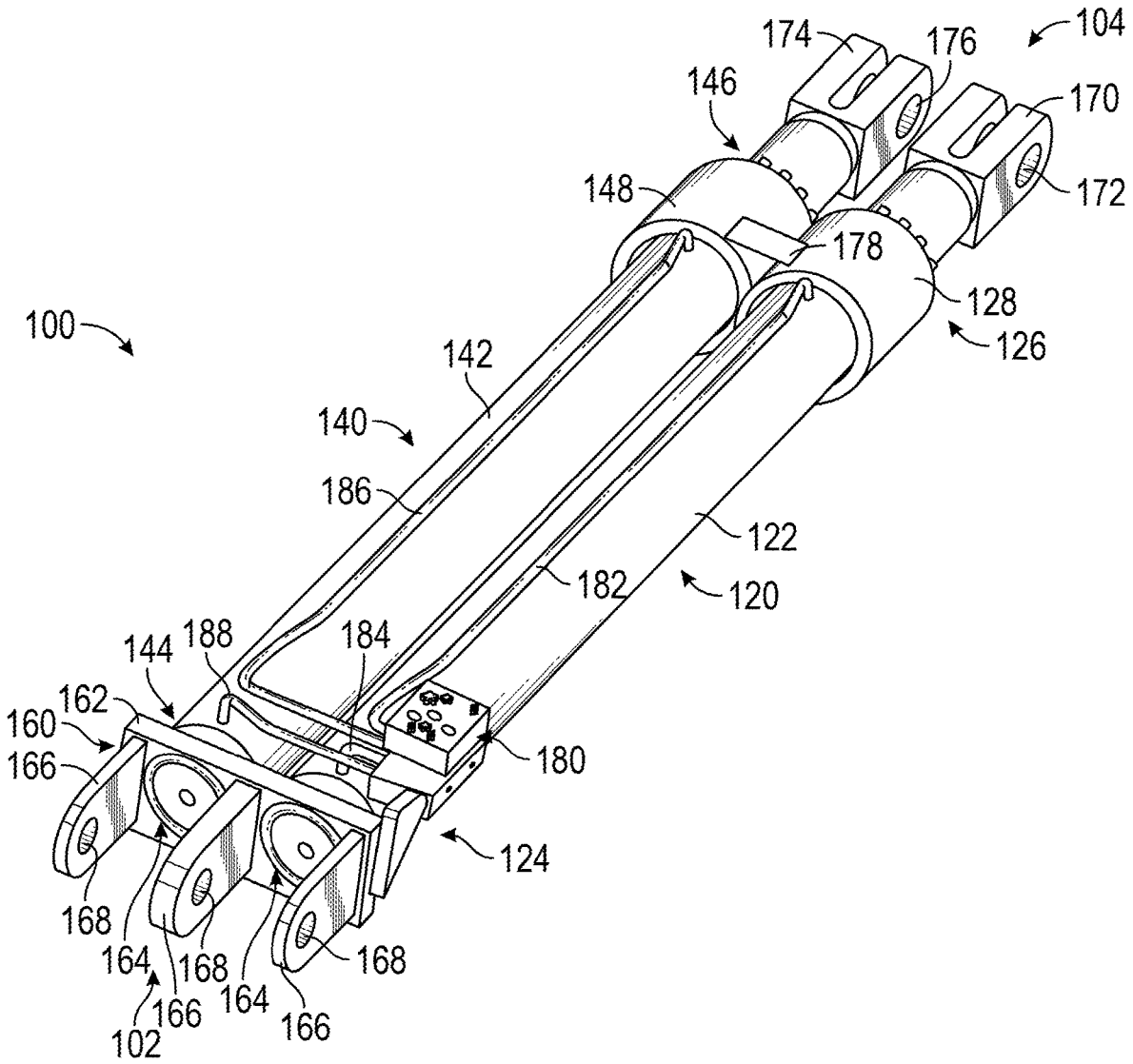
FIG. 3 is a perspective view of the actuator assembly of FIG. 2, according to an exemplary embodiment.
Figure 4:
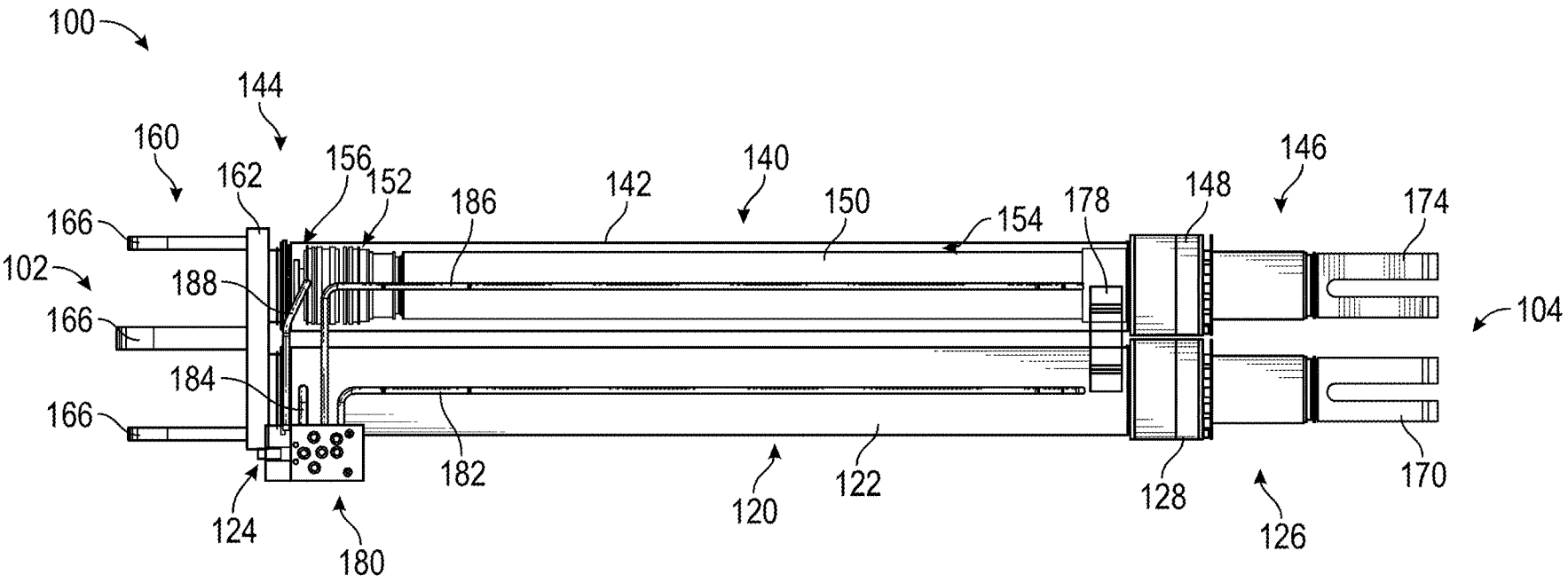
FIG. 4 is a top plan view of the actuator assembly of FIG. 2, according to an exemplary embodiment.

As shown in FIGS. 1 and 2, the boom 40 includes a second actuator (e.g., a conjoined twin actuator assembly, main boom actuator assembly, etc.), shown as actuator assembly 100. According to an exemplary embodiment, the actuator assembly 100 is positioned to selectively reposition (e.g., lift, rotate, elevate, etc.) the main boom 70 relative to the tower boom 50 about the main boom pivot 58. In some embodiments, the actuator assembly 100 is configured to replace the tower lift cylinder 34. As shown in FIGS. 1-4, the actuator assembly 100 has a first end, shown as lower end 102, and an opposing second end, shown as upper end 104. As shown in FIGS. 2-4, the actuator assembly 100 includes a first actuator (e.g., pneumatic cylinder, electric actuator, hydraulic cylinder, etc.), shown as right actuator 120, and a second actuator (e.g., pneumatic cylinder, electric actuator, hydraulic cylinder, etc.), shown as left actuator 140.

As shown in FIGS. 2-4, the right actuator 120 includes a cylinder, shown as right cylinder 122, having a first end, shown as lower end 124, and an opposing second end, shown as upper end 126. As shown in FIGS. 2-4, the right actuator 120 includes a cylinder head, shown as right cylinder head 128, positioned at the upper end 126 of the right cylinder 122. As shown in FIGS. 3 and 4, the left actuator 140 includes a cylinder, shown as left cylinder 142, having a first end, shown as lower end 144, and an opposing second end, shown as upper end 146. As shown in FIGS. 3 and 4, the left actuator 140 includes a cylinder head, shown as left cylinder head 148, positioned at the upper end 146 of the left cylinder 142.

As shown in FIG. 4, the left actuator 140 includes a rod, shown as left cylinder rod 150, disposed within an internal volume defined by the left cylinder 142. The left cylinder rod 150 has a piston assembly (e.g., a piston, seals, etc.), shown as left piston 152, positioned at an end thereof (e.g., a first end, a lower end thereof, an end proximate the lower end 144 of the left actuator 140, etc.). As shown in FIG. 4, the left piston 152 separates the internal volume of the left cylinder 142 into a first chamber, shown as left retraction chamber 154, and a second chamber, shown as left extension chamber 156. According to an exemplary embodiment, the left extension chamber 156 increases in volume and the left retraction chamber 154 decreases in volume as the left cylinder rod 150 extends from the left cylinder 142, and the left extension chamber 156 decreases in volume and the left retraction chamber 154 increases in volume as the left cylinder rod 150 retracts within the left cylinder 142. As shown in FIG. 4, the left retraction chamber 154 forms a first, dynamic internal volume of the left cylinder 142 positioned between the left piston 152 and the left cylinder head 148 positioned at the upper end 146 of the left actuator 140 and the left extension chamber 156 forms a second, dynamic internal volume of the left cylinder 142 positioned between the left piston 152 and the lower end 144 of the left actuator 140 (e.g., the amount of volume within the first, dynamic internal volume and the second, internal volume is dependent on the position of the left piston 152 along the length of the left cylinder 142, etc.).

According to an exemplary embodiment, the right actuator 120 includes a right cylinder rod (e.g., similar to the left cylinder rod 150, etc.) disposed within an internal volume defined by the left cylinder 142 and has a right piston (e.g., similar to the left piston 152, etc.) positioned at an end thereof (e.g., a first end, a lower end thereof, an end proximate the lower end 124 of the right actuator 120, etc.). The right piston may separate the internal volume of the right cylinder 122 into a right retraction chamber (e.g., similar to the left retraction chamber 154, etc.) and a right extension chamber (e.g., similar to the left extension chamber 156, etc.). According to an exemplary embodiment, the right extension chamber increases in volume and the right retraction chamber decreases in volume as the right cylinder rod extends from the right cylinder 122, and the right extension chamber decreases in volume and the right retraction chamber increases in volume as the right cylinder rod retracts within the right cylinder 122. The right retraction chamber may form a first, dynamic internal volume of the right cylinder 122 positioned between the right piston and the right cylinder head 128 positioned at the upper end 126 of the right actuator 120 and the right extension chamber may form a second, dynamic internal volume of the right cylinder 122 positioned between the right piston and the lower end 124 of the right actuator 120 (e.g., the amount of volume within the first, dynamic internal volume and the second, internal volume is dependent on the position of the right piston along the length of the right cylinder 122, etc.).

As shown in FIGS. 2-4, the actuator assembly 100 includes a first coupler (e.g., a rigid coupler, a single clevis joint, etc.), shown as lower coupling bracket 160. According to an exemplary embodiment, the lower coupling bracket 160 is configured to pivotally couple the lower end 102 of the actuator assembly 100 to the boom 40. According to the exemplary embodiment shown in FIGS. 2-4, the lower coupling bracket 160 includes a clevis bracket. In other embodiments, the lower coupling bracket 160 includes another type of bracket and/or coupler. As shown in FIGS. 3 and 4, the lower coupling bracket 160 includes a body, shown as coupling plate 162. As shown in FIG. 3, the coupling plate 162 defines a pair of apertures, shown as cylinder apertures 164. The cylinder apertures 164 are configured (e.g., sized, positioned, etc.) to receive the lower end 124 of the right cylinder 122 and the lower end 144 of the left cylinder 142, thereby rigidly coupling the right actuator 120 and the left actuator 140 at the lower end 102 of the actuator assembly 100. As shown in FIGS. 3 and 4, the lower coupling bracket 160 includes a plurality of extensions, shown as bracket arms 166, extending from the coupling plate 162. As shown in FIGS. 2 and 3, each of the bracket arms 166 define an aperture, shown as coupling aperture 168.

As shown is FIGS. 1 and 2, the boom 40 includes a link, shown as intermediate link 80. As shown in FIG. 2, the intermediate link 80 includes a first link, shown as link 82, having a first end pivotally coupled (e.g., pinned, etc.) to the upper end 54 of the tower boom 50 at a joint, shown as pivot 56, and a second end pivotally coupled (e.g., pinned, etc.) to the lower coupling bracket 160 at a joint, shown as pivot 86. According to an exemplary embodiment, the second end of the link 82 defines an aperture configured (e.g., sized, positioned, etc.) to correspond with the coupling apertures 168 of the bracket arms 166 to receive a fastener (e.g., a clevis pin, etc.) and pivotally couple the link 82 to the lower coupling bracket 160. The link 82 may thereby pivotally couple the lower end 102 of the actuator assembly 100 to the tower boom 50.

As shown in FIG. 2, the intermediate link 80 includes a second link, shown as link 84, having a first end pivotally coupled (e.g., pinned, etc.) to the lower end 72 of the main boom 70 at a joint, shown as pivot 76, and a second end pivotally coupled (e.g., pinned, etc.) to the link 82 at a joint, shown as pivot 88. The link 84 may thereby pivotally couple the lower end 102 of the actuator assembly 100 to the main boom 70. In other embodiments, the intermediate link 80 does not include the link 84 such that the intermediate link 80 only couples the lower end 102 of the actuator assembly 100 to the tower boom 50. In still other embodiments, the boom 40 does not include the intermediate link 80. In such an embodiment, the lower coupling bracket 160 may be configured to directly couple the actuator assembly 100 to the tower boom 50 at the pivot 56.

As shown in FIGS. 2-4, the actuator assembly 100 includes a second coupler, shown as upper, right coupling bracket 170, coupled to the upper end 126 of the right cylinder 122 (e.g., to an opposing second end of the right cylinder rod opposite the right piston, etc.). As shown in FIGS. 3 and 4, the actuator assembly 100 includes a third coupler, shown as upper, left coupling bracket 174, coupled to the upper end 146 of the left cylinder 142 (e.g., to an opposing second end of the left cylinder rod 150 opposite the left piston 152, etc.). According to the exemplary embodiment shown in FIGS. 2-4, the upper, right coupling bracket 170 and the upper, left coupling bracket 174 each include a clevis bracket. In other embodiments, the upper, right coupling bracket 170 and/or the upper, left coupling bracket 174 include another type of bracket and/or coupler. As shown in FIGS. 2-3, the upper, right coupling bracket 170 and the upper, left coupling bracket 174 each define apertures, shown as coupling aperture 172 and coupling aperture 176, respectively.

As shown in FIG. 2, the main boom 70 includes an interface, shown as cylinder interface 96, positioned along a length of the main boom 70 (e.g., between the lower end 72 and the upper end 74 of the main boom 70, etc.). According to an exemplary embodiment, the cylinder interface 96 defines an aperture. The aperture of the cylinder interface 96 may be configured (e.g., sized, positioned, etc.) to align with the coupling apertures 172 of the upper, right coupling bracket 170 and the coupling apertures 176 of the upper, left coupling bracket 174 to receive a fastener (e.g., a single clevis pin, etc.). The upper, right coupling bracket 170 and the upper, left coupling bracket 174 may thereby directly and cooperatively pivotally couple the upper end 104 of the actuator assembly 100 to the main boom 70 at a joint, shown as pivot 78 (e.g., each of the right actuator 120 and the left actuator 140 is independently coupled to the main boom 70; the upper, right coupling bracket 170 couples the right cylinder 122 to the main boom 70; the upper, left coupling bracket 174 couples the left cylinder 142 to the main boom 70; etc.). In other embodiments, (i) the lower coupling bracket 160 is coupled to the lift base 20 and (ii) the right coupling bracket 170 and the left coupling bracket 174 are coupled to the tower boom 50 (e.g., the actuator assembly 100 replaces the tower lift cylinder 34, the boom 40 only includes the tower boom 50, etc.).

As shown in FIGS. 3 and 4, the actuator assembly 100 includes a fourth coupler (e.g., a flexible joint member, a flexible element, a flexible coupler, etc.), shown as upper coupler 178, positioned to flexibly join the upper end 126 of the right cylinder 122 and the upper end 146 of the left cylinder 142. According to an exemplary embodiment, the actuator assembly 100 having a flexible joint provided by the upper coupler 178 facilitates the upper end 126 of the right cylinder 122 and the upper end 146 of the left cylinder 142 to move, flex, and/or float relative to one another as the boom 40 (e.g., the main boom 70, the cylinder interface 96, the tower boom 50, the intermediate link 80, etc.) moves in response to various loading conditions (e.g., torsional loading, non-longitudinal loading imparted by deflection of the lift device 10, etc.). By way of example, the upper coupler 178 may provide a target amount of flex and/or movement such that the actuator assembly 100 is not subject to high, non-longitudinal stresses induced from movement and/or deflection of surrounding structures (e.g., the cylinder interface 96, the main boom 70, the tower boom 50, the intermediate link 80, etc.).

As shown in FIGS. 2-4, the actuator assembly 100 includes a valve assembly having a valve block, shown as actuator valve block 180. As shown in FIGS. 3 and 4, the actuator valve block 180 includes a first flow conduit, shown as right retraction chamber tube 182; a second flow conduit, shown as right extension chamber tube 184; a third flow conduit, shown as left retraction chamber tube 186; and a fourth flow conduit, shown as left extension chamber tube 188. According to an exemplary embodiment, the right retraction chamber tube 182 fluidly couples the actuator valve block 180 with the right retraction chamber of the right cylinder 122, the right extension chamber tube 184 fluidly couples the actuator valve block 180 with the right extension chamber of the right cylinder 122, the left retraction chamber tube 186 fluidly couples the actuator valve block 180 with the left retraction chamber 154 of the left cylinder 142, and the left extension chamber tube 188 fluidly couples the actuator valve block 180 with the left extension chamber 156 of the left cylinder 142. The actuator valve block 180 may thereby be in fluid communication (e.g., hydraulic fluid communication, etc.) with each of the right extension chamber of the right cylinder 122, the right retraction chamber of the right cylinder 122, the left retraction chamber 154 of the left cylinder 142, and the left extension chamber 156 of the left cylinder 142.

According to an exemplary embodiment, the actuator valve block 180 includes an individual valve block having single set of load holding valves. The single set of load holding valves may include (i) a first holding valve (e.g., a retraction chamber holding valve, etc.) fluidly coupled to the right retraction chamber tube 182 and the left retraction chamber tube 186 and (ii) a second holding valve (e.g., an extension chamber holding valve, etc.) fluidly coupled to the right extension chamber tube 184 and the left extension chamber tube 188. The actuator assembly 100 having the actuator valve block 180 provides several advantages relative to systems employing multiple valve blocks and/or multiple sets of loading holding valves (e.g., a first independent valve block associated with the right actuator 120 and a second independent valve block associated with the left actuator 140, etc.).

By way of example, the actuator valve block 180 may facilitate providing equal pressures within the right cylinder 122 and the left cylinder 142 during an extension operation and/or a retraction operation thereof. The actuator assembly 100 may thereby facilitate providing equal forces with the right actuator 120 and the left actuator 140 to the main boom 70. A dual valve block design may operate non-uniformly (e.g., where the two cylinders operate in a ratcheting fashion as the extension operations and the retraction operations of each cylinder may not be synchronized, etc.). According to an exemplary embodiment, the actuator valve block 180 eliminates such ratcheting, as the right actuator 120 and the left actuator 140 are driven by a single source, the actuator valve block 180.

By way of another example, the actuator valve block 180 may facilitate providing even loading even upon failure of a seal within the actuator assembly 100 (e.g., in the right actuator 120, in the left actuator 140, etc.). Systems having two sets of load holding valves may exhibit uneven loading as the failed cylinder may not maintain pressure and provide a lower force, while the operational cylinder may remain at a target pressure. According to an exemplary embodiment, the actuator valve block 180 eliminates such uneven loading even during a seal failure in one of the cylinders by distributing the load through a single set of load holding valves (e.g., one load holding valve for the pair of extension chambers and one load holding valve for the pair of retraction chambers).

As shown in FIG. 2, the actuator assembly 100 is positioned between the main boom 70 and the tower boom 50, within a region, shown as actuator space 98, when the boom 40 is configured in a stowed position. According to an exemplary embodiment, the conjoined twin cylinder arrangement of the actuator assembly 100 facilitates decreasing a dimension of the actuator space 98 relative to traditional, single cylinder actuator designs, making the boom 40 more compact (e.g., a collapsed or stowed height thereof, allowing the lift device 10 to meet stowed height requirements for transportation, etc.). According to an exemplary embodiment, the conjoined twin cylinder arrangement of the actuator assembly 100 facilitates the use of smaller diameter cylinders (e.g., eight inch diameter cylinders, etc.) in place of a single, large diameter cylinder (e.g., a twelve inch diameter cylinder, etc.), while still generating the same or increased force. The larger diameter cylinder required for a single cylinder design may not fit within the reduced region of the actuator space 98 and/or may require special materials (e.g., expensive materials, materials that are difficult to obtain, non-existent materials, etc.) to construct.

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the elements of the systems and methods as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

The invention claimed is:

1. A boom assembly comprising:

a boom including:

a first boom; and a second boom pivotally coupled to the first boom; and an actuator assembly having (i) a first end coupled to the first boom and (ii) an opposing second end coupled to the second boom, the actuator assembly comprising:

a first actuator;

a second actuator flexibly joined to the first actuator at the opposing second end of the actuator assembly; and a rigid coupler positioned to fixedly couple the first actuator and the second actuator together at the first end of the actuator assembly, wherein the rigid coupler is configured to pivotally couple the first end of the actuator assembly to a pivot point of the boom, and wherein the rigid coupler is configured to pivot with the first end of the actuator assembly about the pivot point;

wherein the first actuator and the second actuator are configured to move relative to one another in response to various loading conditions.

2. The boom assembly of claim 1, wherein the actuator assembly further comprises:

a first bracket coupled to the first actuator at the opposing second end of the actuator assembly; and a second bracket coupled to the second actuator at the opposing second end of the actuator assembly;

wherein the first bracket independently couples the first actuator to the second boom and the second bracket independently couples the second actuator to the second boom.

3. The boom assembly of claim 2, wherein the actuator assembly further includes a flexible element positioned to flexibly couple the first actuator and the second actuator proximate the opposing second end of the actuator assembly.

4. The boom assembly of claim 3, wherein the flexible element is positioned between (i) the rigid coupler and (ii) the first bracket and the second bracket.

5. The boom assembly of claim 3, wherein the flexible element facilitates relative movement between the first actuator and the second actuator.

6. The boom assembly of claim 1, wherein the boom includes an intermediate link that defines the pivot point, wherein the intermediate link is positioned between the rigid coupler and the first boom such that the intermediate link couples the first end of the actuator assembly to the first boom.

7. The boom assembly of claim 1, wherein:

each of the first actuator and the second actuator includes:

a cylinder defining an internal volume;

a rod disposed within the cylinder; and a piston coupled to the rod and positioned within the internal volume, wherein the piston separates the internal volume of the cylinder into an extension chamber that increases in volume when the rod extends from the cylinder and a retraction chamber that decreases in volume when the rod extends from the cylinder; and the actuator assembly further includes a valve assembly having a single valve block fluidly coupled to the extension chamber of the first actuator, the retraction chamber of the first actuator, the extension chamber of the second actuator, and the retraction chamber of the second actuator, wherein the single valve block includes:

a first holding valve fluidly coupled to the extension chamber of the first actuator and the extension chamber of the second actuator; and a second holding valve fluidly coupled to the retraction chamber of the first actuator and the retraction chamber of the second actuator.

8. An actuator assembly for a lift device, the actuator assembly comprising:

a first actuator having a first end and an opposing second end;

a second actuator having a third end and an opposing fourth end;

a first coupler positioned to rigidly couple the first end of the first actuator and the third end of the second actuator together;

a second coupler positioned at the opposing second end of the first actuator; and a third coupler positioned at the opposing fourth end of the second actuator;

a fourth coupler extending between the first actuator and the second actuator, the fourth coupler flexibly coupling the first actuator and the second actuator together, which facilitates relative movement between the first actuator and the second actuator;

wherein the first coupler is configured to pivotally couple the first end of the first actuator and the third end of the second actuator to a pivot point defined by a base of the lift device or a boom assembly of the lift device;

wherein the first coupler is configured to pivot with the first end of the first actuator and the third end of the second actuator about the pivot point;

wherein the first coupler is configured to be detachable from the pivot point with the first actuator and the second actuator;

wherein the second coupler is configured to pivotally couple the opposing second end of the first actuator to the boom assembly, independent of the second actuator; and wherein the third coupler is configured to pivotally couple the opposing fourth end of the second actuator to the boom assembly, independent of the first actuator.

9. The actuator assembly of claim 8, wherein the fourth coupler is positioned proximate the opposing second end of the first actuator and the opposing fourth end of the second actuator.

10. The actuator assembly of claim 8, wherein the first coupler is configured to pivotally couple the first end of the first actuator and the third end of the second actuator to the base of the lift device.

11. The actuator assembly of claim 8, wherein the first coupler is configured to pivotally couple the first end of the first actuator and the third end of the second actuator to a first boom of the boom assembly, wherein the second coupler is configured to pivotally couple the opposing second end of the first actuator to a second boom of the boom assembly, and wherein the third coupler is configured to pivotally couple the opposing fourth end of the second actuator to the second boom.

12. A lift device comprising:

a base;

a boom pivotally coupled to the base; and an actuator assembly having (i) a first end coupled to the base and (ii) an opposing second end coupled the boom, the actuator assembly comprising:

a first actuator;

a second actuator;

a rigid coupler coupling the first actuator and the second actuator together proximate one of the first end or the opposing second end of the actuator assembly, wherein the rigid coupler is coupled to a pivot point of one of the boom or the base, and wherein the rigid coupler pivots with the first actuator and the second actuator about the pivot point; and a flexible coupler coupling the first actuator and the second actuator together proximate the other of the first end or the opposing second end of the actuator assembly.

13. The lift device of claim 12, wherein the rigid coupler pivotally couples the first end of the actuator assembly to the pivot point.

14. The lift device of claim 12, wherein the first actuator includes a first bracket coupled at an end thereof opposite the rigid coupler, wherein the second actuator includes a second bracket independent of the first bracket and coupled at an end thereof opposite the rigid coupler, and wherein the first bracket and the second bracket pivotally couple the opposing second end of the actuator assembly to the boom.

15. The lift device of claim 12, wherein the rigid coupler pivotally couples the opposing second end of the actuator assembly to the pivot point.

16. The lift device of claim 12, wherein the boom includes a first boom and a second boom pivotally coupled to the first boom.

17. The lift device of claim 12, wherein the boom is a telescopic boom.

18. The boom assembly of claim 6, wherein the intermediate link includes (i) a first link (a) extending between the rigid coupler and the first boom and (b) defining the pivot point and (ii) a second link extending between the first link and the second boom.

* * * * *